United States Patent [19]

Joh

[11] 4,418,434

[45] Dec. 6, 1983

[54] DEODORIZING BOOT STAND

[76] Inventor: Choon S. Joh, 788 Rodriquez St. #61, Watsonville, Calif. 95076

[21] Appl. No.: 355,352

[22] Filed: Mar. 8, 1982

[51] Int. Cl.[3] ..... A43D 3/00

[52] U.S. Cl. ..... 12/128 B

[58] Field of Search ..... 12/128 B, 1 A, 123.5

[56] References Cited

U.S. PATENT DOCUMENTS

| | | | |
|---|---|---|---|
| 1,582,143 | 4/1926 | Perrault et al. . | |
| 1,755,248 | 4/1930 | Flink . | |
| 2,460,405 | 2/1949 | Abrams et al. | 12/128 |
| 2,510,315 | 6/1950 | Malberg | 12/128.6 |
| 3,088,143 | 5/1963 | Richter et al. | 12/1 A |
| 3,681,804 | 8/1972 | Caputo | 12/114.6 |
| 3,979,786 | 9/1976 | Vierra et al. | 12/128 B |

*Primary Examiner*—Patrick D. Lawson

*Attorney, Agent, or Firm*—Klein & Szekeres

[57] ABSTRACT

Apparatus for the storage of boots and shoes includes two or more hollow boot-shaped form members removably supported in an inverted upright position by a base. The forms each have a foot-shaped end with a sole-shaped surface. Holes in the sole-shaped surface communicate with the hollow interior. Each of the forms has a compartment integrally formed in the foot-shaped end, with holes in the walls of the compartment communicating with the hollow interior, so that when a deodorizing and/or disinfecting substance is placed in the compartment, and the form is placed inside a boot, vapors emanating from the substance can circulate to the interior of the boot. Each of the forms also has integral means for (a) allowing the escape of air as the form is inserted into a boot, and (b) facilitating the removal of condensed moisture from the boot's interior.

10 Claims, 3 Drawing Figures

10
12
14
16
16a
16b
18
20
22
24
26
28
30
32
34
36
38
40
42
43
44
46
48
50
2
3

DEODORIZING BOOT STAND

BACKGROUND OF THE INVENTION

This invention relates to the field of shoe and boot forms used for maintaining the shape of shoes and boots when such articles of footware are not being worn. In particular, the invention relates to devices of this type which also include a compartment for the storage of a deodorizing or disinfecting substance.

Through the years, there have been many types of forms, known as "trees", that have been devised for preserving and maintaining the shape of shoes and boots when such articles are not being worn. While the typical prior art shoe or boot tree is capable of achieving satisfactory results in this regard, there have been attempts in the prior art to provide boot or shoe forms which accomplish other functions along with the basic function of preserving the shape of the footware. For example, there have been attempts in the past to provide a shoe or boot tree which performs a deodorizing or disinfecting function when it is inserted into the footware. Such attempts are exemplified by the devices disclosed in U.S. Pat. No. 2,460,405 to Abrams et al and in U.S. Pat. No. 2,510,315 to Malberg. The approach used in these devices is to provide, in the body of a shoe tree, a compartment adapted to receive a disinfecting or deodorizing substance, with apertures in the compartment which permit the circulation of fumes or vapors emanating from the substance within the compartment.

One problem with the prior art devices is that they were designed specifically for use in shoes or other low cut forms of footware. Thus, these designs do not address some of the problems that are peculiar to boots. Specifically, a boot tends to collect more perspiration in its interior than does a shoe. Consequently, it is frequently desirable to store boots in an upside down position to allow the drainage of such perspiration. The shoe trees disclosed in the Abrams et al and Malberg patents do not provide any convenient means for achieving an inverted storage position.

In addition, it is frequently desirable to provide some means for maintaining the shape of the calf portion of the boot. The devices disclosed in the aforementioned prior art patents were not designed to perform such a function. While the use of the forms or trees specifically designed for boots is well known, (e.g. U.S. Pat. No. 1,582,143—Perrault et al and U.S. Pat. No. 1,755,248—Flink), such devices frequently require relatively complex mechanisms to overcome the inherent difficulty in inserting the form-fitting tree into the boot.

From the foregoing, it can be appreciated that it would be advantageous to provide a form or tree specifically designed for boots, in that provision would be made for storing the boots in an inverted position, while also allowing for ease of insertion into the boot. It can be seen that it would be desirable to have these advantages in a device which maintains the shape of the boot in storage, while also providing means for deodorizing or sanitizing the boot, if desired. Furthermore, it would be advantageous to provide such a device which is adaptable also for use with low-cut shoes, and which lends itself to relatively simple and economical construction, while also providing a sturdy and aesthetically pleasing structure.

SUMMARY OF THE INVENTION

Briefly, the present invention comprises two or more boot- or shoe-shaped form members removably supported by a base so as to be in an upright position, with the foot-shaped part of the forms uppermost. The forms are substantially hollow, at least at the foot-shaped end, with the top of the form (the foot-shaped end) being perforated with a plurality of holes which communicate with the hollow space in the form's interior. Each of the form members has a recessed compartment integrally formed at or near the foot-shaped end thereof. At least one of the walls of the compartment is perforated with a plurality of holes which communicate with the hollow interior of the form, and the compartment is adapted for the attachment of a removable cover. As will be seen, the purpose of the compartment is to contain a deodorizing or disinfecting substance, preferably in the form of a small sachet. When such a sachet, for example, is placed in the compartment, and the form member is inserted into a boot or shoe, the fumes or vapors emanating from the substance in the sachet pass from the compartment to the interior of the shoe or boot through the holes in the compartment, the hollow space in the form member, and the holes in the foot shaped end of the form member.

Another feature of the invention is the provision of one or more longitudinal troughs extending along each side of the form member. The purpose of the troughs is two-fold: To facilitate the insertion of the form into a boot by allowing the passage of air out of the boot as the form is inserted; and to allow the drainage of moisture from the boot when the boot is stored on the form in an inverted position.

As will be appreciated from the detailed description which follows, the present invention offers the advantages of effectively and efficiently deodorizing and/or disinfecting an article of footware, while also providing the desired shape-maintaining function. Moreover, when used with boots, the structure of the invention allows for ease of insertion of the form member, while also allowing efficient removal of moisture therefrom. All of the aforementioned features and advantages are provided with a structure which is easily and economically manufactured.

DETAILED DESCRIPTION OF THE PREFERRED EMBODIMENT

Figures 1, 2, 3:
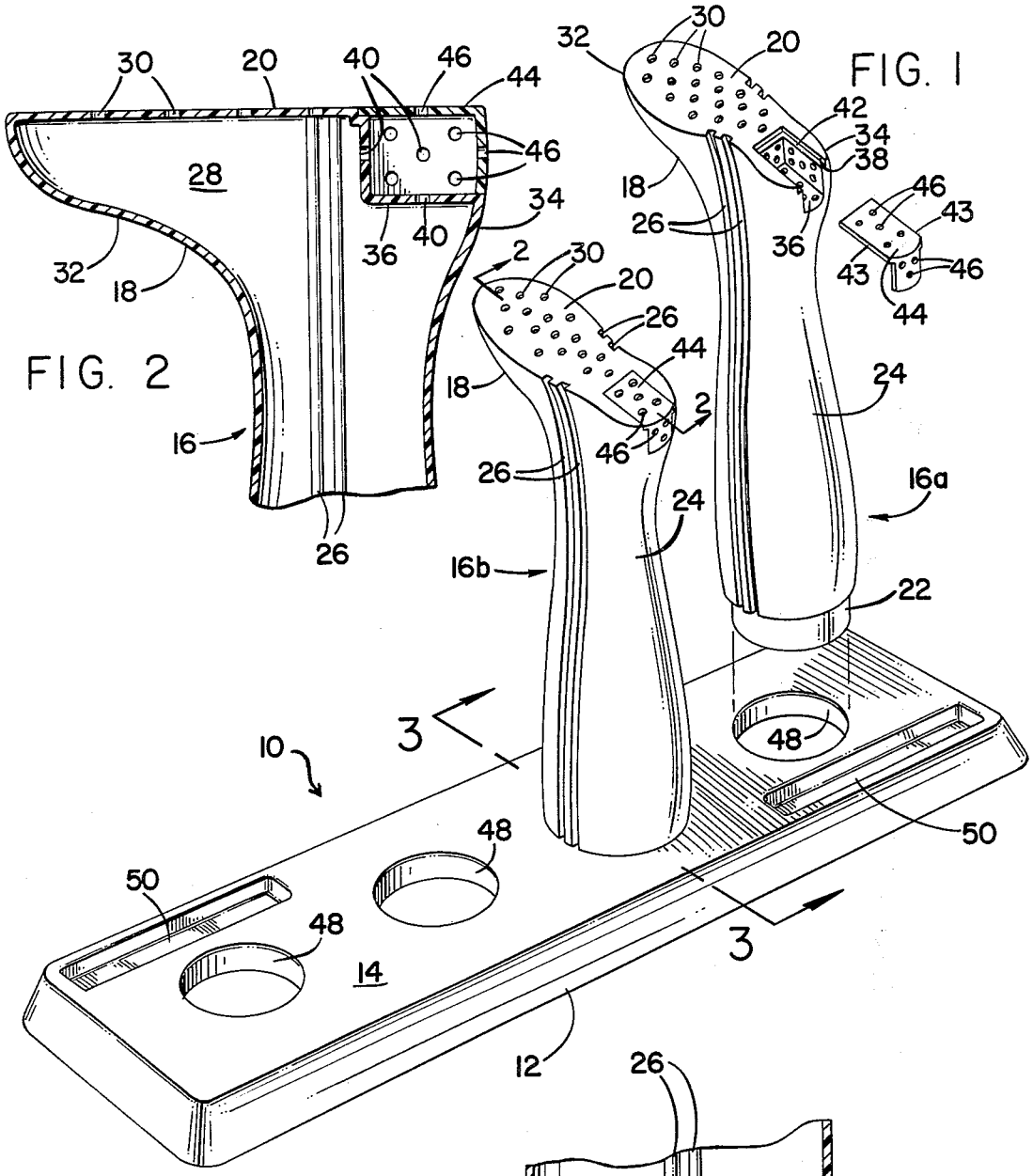
FIG. 1 is a perspective view of a boot stand in accordance with the present invention, showing the base thereof and a pair of form members.
FIG. 2 is a cross-sectional view of one of the form members of FIG. 1 along line 2—2 thereof.
FIG. 3 is a cross-sectional view of the base and one form member, taken along line 3—3 of FIG. 1.

Referring to the drawings, the numeral 10 designates a boot stand constructed in accordance with the preferred embodiment of the present invention. The stand 10 includes a base 12 having a substantially planar upper surface 14, and at least two form members **16*a* and 16*b***, shaped, as will be further described below, to accommodate a left boot and a right boot, respectively. As will be made clear from the description that follows, the invention can be made to accommodate any number of form members.

In describing the form members 16*a* and 16*b*, reference will be made generally to "the form member 16" since, except for shape and possibly dimensions, all of the form members will be similarly constructed.

As best shown in FIG. 1, each of the form members 16 has a generally foot-shaped first or upper end 18, having a substantially flat horizontal lateral surface 20 in the outline shape of a shoe sole. As best shown in FIGS. 1 and 3, the opposite or lower end of the form 16 terminates in a cylindrical extension or boss 22, the purpose of which will be described later on. Extending longitudinally between the upper end 18 and the boss 22 is an intermediate portion 24 in the general configuration of the calf and ankle portion of a boot. One or more longitudinal channels or troughs 26 extend from the upper surface 20 down along at least a substantial length of the intermediate portion 24 of the form member 16, on each side thereof. Preferably, at least two such troughs 26 are formed in each side of the form members 16, as shown. The purpose of the troughs 26 will be described later on.

The form members 16 are substantially hollow, with a hollow space 28 being provided at least in the foot-shaped portion 18 thereof. A plurality of holes 30 in the upper surface 20 of the form member 16 communicate with the hollow interior space 28. The foot-shaped portion 18 of the form member 16, being in the general configuration of a human foot, has a toe-shaped end 32 and a heel-shaped end 34. Integrally formed in the heel-shaped end 34 so as to extend into the space 28 is a compartment or receptacle 36, suitably dimensioned to contain a package (preferably a sachet) of deodorizing or disinfecting material (not shown). Access to the compartment 36 is gained through an opening 38 in the heel-shaped portion 34 (FIG. 1). The walls of the compartment 36 are provided with a plurality of holes 40 which communicate with the interior space 28, as best shown in FIG. 2. A groove or track 42 is provided along at least two parallel peripheral edges of the opening 38, as best shown in FIG. 1. The track 42 is dimensioned to engage the peripheral edges 43 of a removable cover member 44, which can thus be slid on a track 42 selectably to cover and uncover the compartment 36. When the cover member 44 is in its closed position, as shown in FIG. 2, it is flush with the upper surface 20 of the form member 16. The cover member 44 is provided with a plurality of holes 46 which communicate with the interior of the compartment 36.

As shown in FIGS. 2 and 3, the base 12 is provided with a plurality of cylindrical apertures 48. Although at least two such apertures 48 are required, any number may be provided. As shown in FIG. 3, each of the apertures 48 is dimensioned snugly to receive the boss or extension 22 of one of the form members 16. This arrangement allows the form member 16 to be securely supported in an upright position with the lateral upper surface 20 topmost, as shown. The base 12 may also be provided with one or more compartments 50, in the form of depressions in the upper surface 14 thereof, for storage of various implements (such as brushes and the like) which may be used in the care and maintenance of footware.

When it is desired to store an article of footware, such as a boot, a package of deodorizing and/or disinfecting substance is inserted into the compartment 36, and the compartment is closed by means of the cover 44. The form member 16 is then inserted into the boot. Since the form member 16 is shaped and dimensioned to conform closely to the interior dimensions of the selected article of footware, insertion of the form member may be difficult without some means for allowing the escape of air from the interior of the boot as the form member is inserted. The troughs 26 facilitate the insertion process by providing channels for the escape of this air. Once insertion is completed, the boot is stored in an inverted position by the insertion of the boss or extension 22 of the form member 16 into a selected aperture 48 in the base 12. While thus stored, vapors or fumes emanating from the substance in the compartment 36 are allowed to circulate into the interior of the boot by means of the apertures 40 in the compartment 36, the hollow interior space 28 in the foot-shaped portion 18, and the holes 30 in the lateral upper surface 20 of the form member 16. Circulation is also provided by the holes 46 in the cover member 44. Moreover, removal of condensed moisture from the interior of the boot is enhanced by the troughs which provide drainage channels for such moisture. When it is desired to remove the form members from the articles of footware, the cylindrical boss 22 provides a convenient grip.

It will be appreciated that the form members 16 can be shaped and dimensioned to accommodate any selected article of footware. Thus, for example, although the preferred embodiment described herein is specifically designed for use with a calf-length boot or the like, low cut articles of footware, such as ordinary shoes, can also be accommodated. It will also be appreciated that the components of the invention can be economically manufactured from such materials as molded plastic.

There has thus been described an apparatus for the storage of articles of footware which provides for the effective and efficient deodorizing and/or disinfecting of such articles while they are in storage, while also providing means for the efficient removal of moisture therefrom. The present invention also provides the necessary shape-preserving function, using a form member which is easily inserted into and removed from the footware article stored thereon. The apparatus can be easily and economically manufactured and the components thereof are easily assembled and disassembled.

It should be noted that while the embodiment described herein is preferred, modifications thereof will come to mind which are within the scope of the invention. For example, the base 12 can assume any of a variety of shapes and the compartment 36 can be located in the toe-shaped end 32 of the form member 16, or in any other convenient location. Also, the closure means (track 42 and cover 44) can be modified so that the cover is attached by a snap fit, rather than by a sliding action. These and other variations will be apparent to those skilled in the pertinent arts, and should therefore be considered within the spirit and scope of the invention.

What is claimed is:

1. Apparatus for the storage of articles of footware comprising:

a base;

at least a pair of form members shaped and dimensioned substantially to conform to the shape and dimensions of a selected pair of footware articles to be stored thereon, and thereby adapted to maintain the shape of said footware articles when one of said form members is inserted into the interior of one of said footware articles, said form members each having a first end and a second end, said first end having a lateral surface configured generally in the form of a shoe-sole, each of said form members having a hollow portion at least at said first end;

means for removably attaching said second end of each of said form members to said base;

a plurality of holes in said lateral surface of each of said form members, said holes communicating with said hollow portion thereof;

a recessed compartment, integrally formed in each of said form members near said first end thereof, and having a plurality of holes communicating with said hollow portion;

means for accessing said compartment from the exterior of said form member; and closure means for selectably opening and closing said means for accessing;

whereby said compartment is adapted to receive a deodorizing or disinfecting substance productive of vapors, said vapors being passed from said compartment to the interior of said article of footware through said holes in said compartment, said hollow portion, and said holes in said lateral surface when said article of footware is stored on said form member.

2. The apparatus of claim 1, wherein said base has a substantially planar upper surface, and said means for removably attaching said second ends to said base comprises:

a longitudinal projection extending from said second end of each of said form members; and at least two apertures in said planar upper surface of said base each dimensioned to receive snugly said projection.

3. The apparatus of claim 1, wherein each of said form members has a longitudinal intermediate section between said first and second ends, each of said form members further comprising:

air passage means, in said intermediate section, for (a) allowing the escape of air from the interior of an article of footware as said form member is inserted therein, and (b) providing a path for the escape of moisture from the interior of an article of footware which is stored on said form member.

4. The apparatus of claim 3, wherein said air passage means comprises at least a pair of laterally-opposed, longitudinally-directed troughs in each of said form members, extending from said first end thereof through at least a substantial length of said intermediate section.

5. The apparatus of claim 1, wherein said means for accessing said compartment comprises an opening in the surface of said form member communicating with the interior of said compartment and having at least two parallel peripheral edges.

6. The apparatus of claim 5, wherein said parallel peripheral edges each carries means defining a track, and said closure means comprises:

a cover element dimensioned to cover said opening; and means on the periphery of said cover element adapted for slidable engagement with said track;

whereby said closure means is slidable in said track selectably to cover and uncover said opening, and whereby said cover element is substantially flush with the exterior surface of said form member when said opening is covered.

7. The apparatus of claim 6, further comprising a plurality of holes in said cover element adapted for communication with the interior of said compartment when said opening is covered by said cover element.

8. The apparatus of claim 2, wherein said base has an elongate recess in said upper surface thereof adapted to receive a brush.

9. The apparatus of claim 1, wherein said lateral surface has a toe-shaped portion and a heel-shaped portion, said compartment being located in said heel-shaped portion.

10. Apparatus for the storage of articles of footware, comprising:

a base having at least two substantially cylindrical holes therein;

at least two form members, each having a first end shaped and dimensioned substantially to conform to the shape and dimensions of a selected article of footware, and a second end longitudinally spaced from said first end and having a substantially cylindrical boss extending therefrom, said boss dimensioned to be received snugly in at least one of said holes in said base;

an intermediate longitudinal section between said first and second ends of each of said form members;

at least one longitudinally-directed trough extending from said first end to said second end of each of said form members;

a hollow portion in each of said form members at least at said first end, said hollow portion communicating with the exterior of the form member through a plurality of apertures in said first end thereof;

a recessed compartment, integrally formed within each of said form members near said first end thereof, and having a plurality of holes communicating with said hollow portion;

an opening in the exterior surface of each of said form members for accessing said compartment therein; and a removable cover for each of said openings adapted to fit substantially flush with the exterior form member surface surrounding said opening.

* * * * *